United States Patent [19]

Groves

[11] Patent Number: 4,940,190

[45] Date of Patent: Jul. 10, 1990

[54] CONTAINER

[75] Inventor: Maurice C. Groves, Brisbane, Australia

[73] Assignee: Amcor Limited, New South Wales, Australia

[21] Appl. No.: 352,565

[22] Filed: May 16, 1989

[30] Foreign Application Priority Data

Mar. 13, 1989 [AU] Australia ..... PJ3150

[51] Int. Cl.[5] ..... B65D 5/42

[52] U.S. Cl. ..... 229/122; 206/559; 206/804; 206/817; 229/906; 229/DIG. 13

[58] Field of Search ..... 229/122, DIG. 13, 902, 229/906; 206/255, 273, 559, 804, 817; 426/115; 221/312 R

[56] References Cited

U.S. PATENT DOCUMENTS

| | | | |
|---|---|---|---|
| 2,011,383 | 8/1935 | Taylor | 229/DIG. 13 |
| 2,248,843 | 7/1941 | Atwood | 206/804 |
| 2,724,540 | 11/1955 | O'Leary | 229/906 |
| 3,260,405 | 7/1966 | Frischer et al. | 206/804 |
| 3,279,593 | 10/1966 | Cote | 206/273 |
| 3,283,889 | 11/1966 | Hetrick et al. | 426/115 |
| 3,355,082 | 11/1967 | Wood | 229/DIG. 13 |
| 4,585,124 | 4/1986 | Pride | 206/804 |
| 4,664,310 | 5/1987 | Schmidt | 206/804 |

FOREIGN PATENT DOCUMENTS

| | | | |
|---|---|---|---|
| 239727 | 11/1945 | Switzerland | 206/804 |
| 348408 | 5/1931 | United Kingdom . | |
| 412655 | 7/1934 | United Kingdom . | |
| 642831 | 9/1950 | United Kingdom . | |
| 1385540 | 2/1975 | United Kingdom . | |

*Primary Examiner*—Gary E. Elkins
*Attorney, Agent, or Firm*—DeLio & Associates

[57] ABSTRACT

A container for food, the container having an open portion or an openable portion for presenting the food for consumption, a panel with an at least partially frangible portion which can be urged from a position coplanar with the panel to a position extending outwardly of the panel such that when the portion is moved to the extended position the food can be moved towards the open portion or openable portion of the container.

9 Claims, 2 Drawing Sheets

CONTAINER

BACKGROUND AND PRIOR ART

This invention relates to a container. In particular, the invention concerns a container in the form of a tray useful for assisting in the convenient consumption of foods such as, filled rolls, hotdogs, taco's and the like.

The invention will be described by way of example with reference to a container useful for carrying filled rolls or hotdogs. It should be appreciated that the container may be used to carry and assist the consumption of foods other than the two examples given.

Typically, food such as hotdogs or filled rolls are presented to the customer in a paper bag or wrapped in some way and then presented within a paper bag. It sometimes becomes difficult to consume the hotdog without completely removing it from its wrapping or bag. If the hotdog is left within the wrapping or bag, the wrapping or bag needs to be progressively peeled back to progressively reveal more of the hotdog during consumption. Alternatively, the hotdog is completely removed from its wrapping or bag for consumption and there is a danger when this occurs of topping or sauces or the like separating from the hotdog and making the whole consumption process messy.

OBJECT

It is an object of the present invention to provide a container for food such as hotdogs or the like which at least minimises the disadvantages referred to above.

THE INVENTION

According to one aspect, the present invention provides a container for food such as hotdogs and the like, said container having an open portion or an openable portion for presenting the food for consumption, said container having a panel with a portion at least partially frangible therefrom and which can be urged from a position co-planar with the panel to a position extending outwardly of the panel whereby when the frangible portion is moved to the extended position, the food within the container can be moved towards the open or openable portion by a user of the container.

In another aspect of the invention, there is provided a container blank having a base panel and a plurality of side panels with one of the panels having a portion at lease partially frangible therefrom and extending along it.

The container of the invention is preferably a tray having an open top. The tray preferably has an open portion or end.

Preferably, the container has three side panels hinged to edges of the base panel. The side panels need not all be of the same size and shape. It is preferred that two of the side panels extend along opposed edges of the base panel. These opposed side panels may for convenience be of a corresponding size and shape. It is preferred that the edges of the opposed side panels adjacent the open or openable portion of the container be tapered or inclined relative to the base panel.

The partially frangible portion may be provided by a finger or strip of material integral with the container but partially severable therefrom so that the strip may be moved from a position co-planar with one of the panels to a position where it projects from the panel. The strip may be partially die cut relative to the panel or alternatively may be perforated relative to the panel. It is preferred that a trailing edge of the strip be connected to the panel for hinging relative to the panel. A crease or fold line may achieve this. If desired, the strip may be completely severable from the panel. In this case the hinge may be formed by a weakened line. The line may comprise a die cut or perforations.

While the strip may extend along any of the panels which comprise the container, it is preferred that the strip extend along the base panel of the container and be spaced from the open or openable portion. More preferably, the strip extends along the base panel and at least part way along one of the side panels.

The container may be made from any suitable material. Preferably, the container is made from either plastics material or fibreboard or cardboard. In a particular preferred form, the container is made from corrugated board.

THE DRAWINGS

A particular preferred embodiment will now be described in relation to the accompanying drawings in which.

PREFERRED EMBODIMENT

Figure 1:
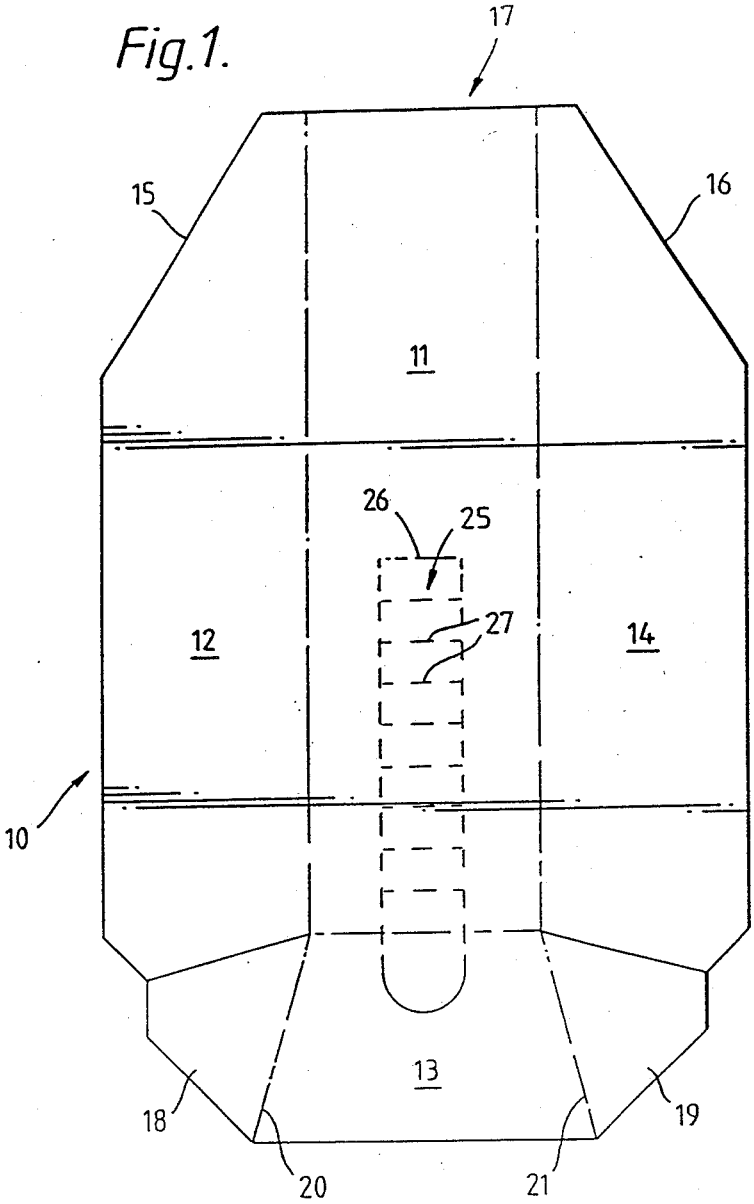
FIG. 1 is a view of a blank according to an embodiment of the invention.

As shown in FIG. 1, the blank 10 has a rectangular base panel 11 to which side panels 12, 13 and 14 are hinged. Opposed side panels 12 and 14 are of corresponding shape and size. Each of the panels 12 and 14 has a tapered or inclined edge 15, 16 respectively adjacent end 17 of the blank.

The side panel 13 of the blank forms an end panel of a container made from the blank. The panel 13 has integral joinder flaps 18, 19 hinged to it about respective fold lines or crease lines 20, 21.

The base panel 11 has a partially frangible finger or strip 25 formed in it and extending along it from a location intermediate ends of the panel and extending part way into panel 13. Strip 25 is hinged to the base panel 11 along line 26 whereas the remainder of the periphery of the strip is severable from both panels 11 and 13. The strip 25 may have a plurality of creases 27 along its length and extending substantially parallel to edge 26.

Figure 2:
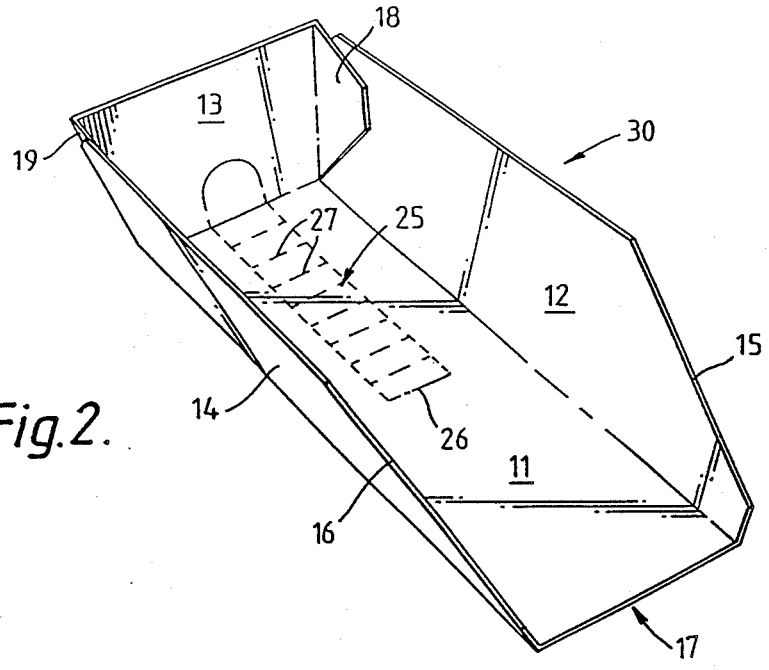
FIG. 2 is a perspective view of a container made from the blank of FIG. 1.

A container 30 made from the blank of FIG. 1 is shown in FIG. 2. Like numerals to that used in FIG. 1, are employed for like features shown in the container of FIG. 2. The tray has an open top and an open portion at the end thereof opposite panel 13. Joiner flaps 18 and 19 are attached to inner surfaces of panels 12 and 14 to complete the tray.

Figure 3:
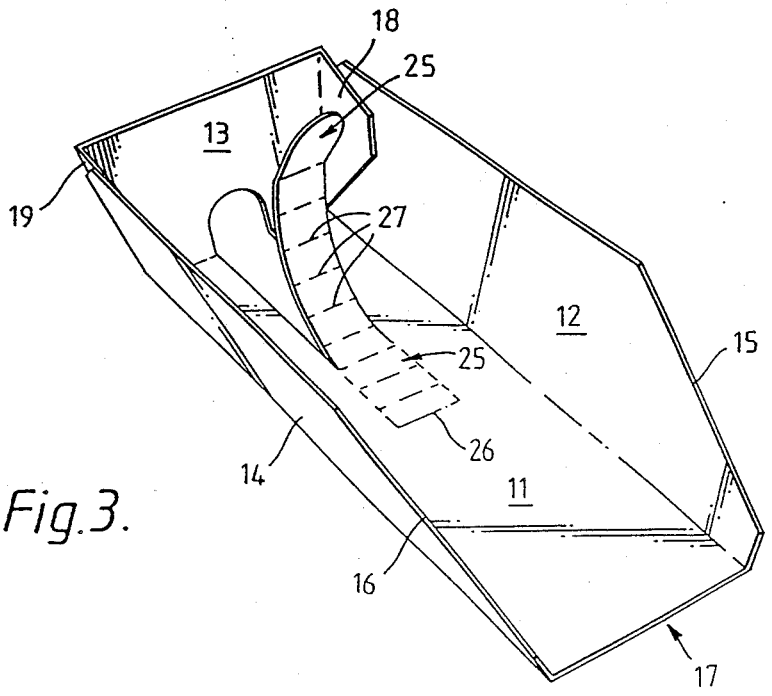
FIG. 3 is a perspective view of the container shown in FIG. 2 showing the partially frangible portion moved out of the plane of the base panel of the container.

During use of the container 30 a hotdog or other food item is placed within the container and rests upon panel 11 with an end of the hotdog projecting beyond end 17 for ready consumption. The hotdog may be held fast by squeezing panels 12 and 14 together while eating from the open end. To expose more of the hotdog for consumption, the pressure on panels 12 and 14 is released and the user presses strip 25 out of the plane of panels 11 and 13 as indicated in FIG. 3. This action enables the hotdog to be further advanced to project once again beyond the open end. This action causes the strip 25 to be severed from panel 13 and then progressively severed from panel 11. The creases or fold line 27 allow a gradual movement of the hotdog during consumption. The strip 25 may be progressively severed from the panel 11 until only edge 26 connects the strip to the panel 11. As previously mentioned the edge 26 may also be a die cut or perforated line and in which case the strip is completely removable from the panel.

It should be appreciated that the container of the invention may be used to advantage for consuming difficult to eat foods, such as taco's, buritto's, filled pocket bread, crepes, rolled pancakes, filled rolls and hotdogs or the like. The food product may be offered for sale simply in the container 30 or alternatively may be presented to the consumer with the container 30 carried within an outer container or bag. The container 30 may be removed from the container or bag to enable the food to be consumed.

I claim:

1. A tray for food such as a hotdog and the like, said tray having an open portion opposed to an end wall, said open portion enabling food to be presented for consumption, and two opposed side walls and a base panel from which said walls depend, said base panel having a portion between said side walls at least partially frangible therefrom, said frangible portion comprising a strip hinged at one end to said base panel at a location intermediate said end wall and said open portion and extending to said end wall at the opposite end, said frangible portion adapted to be urged by a user's finger from a position coplanar with the base panel to a position extending upwardly of the panel whereby when the frangible portion is moved to the extended position, the food within the tray can be moved towards the open portion by a user of the tray.

2. The tray of claim 1 wherein the frangible strip includes a plurality of creases substantially parallel to the strip hinge to permit gradual movement of the food towards said open portion as said strip is progressively severed and extended from said base panel.

3. The tray of claim 2 wherein the frangible strip extends at said end opposite the hinge part way into the end wall.

4. The tray of claim 2 wherein edges of each said opposed side wall adjacent said open portion are inclined relative to the base panel.

5. The tray of claim 4 wherein the side walls are inclined relative to the base panel.

6. The tray of claim 5 wherein the frangible strip is a finger at least partially severable from the panel to reveal an opening in the panel through which a finger of the user can project.

7. The tray of claim 6 wherein the frangible strip is completely severable from the panel and can be removed therefrom.

8. The tray of claim 7 wherein the frangible strip is partially severable from the panel and when in the upwardly extending position is connected to the panel by a fold line.

9. The tray of claim 6 made from corrugated board.

* * * * *